US006178645B1

(12) United States Patent
Lock

(10) Patent No.: US 6,178,645 B1
(45) **Date of Patent: *Jan. 30, 2001**

(54) WINDSCREEN REMOVAL DEVICES

(76) Inventor: Stanley Trevor Lock, C/o. BTB Holdings, Pty Ltd., 1 Wood Street, Bendigo, Victoria 3550 (AU)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/773,597

(22) Filed: Dec. 27, 1996

(30) Foreign Application Priority Data

Jan. 5, 1996 (AU) ..... 7438

(51) Int. Cl.[7] ..... B26B 7/00

(52) U.S. Cl. ..... 30/275.4; 30/277.4; 30/293; 30/294; 30/317

(58) Field of Search ..... 30/272.1, 275.4, 30/277.4, 287, 290, 293, 294, 296.1, 317, 169, 83; 83/881

(56) References Cited

U.S. PATENT DOCUMENTS

| | | | | |
|---|---|---|---|---|
| 2,602,995 | * | 7/1952 | Hurt | 30/169 X |
| 2,990,614 | * | 7/1961 | Taggart | 30/277.4 |
| 3,225,443 | * | 12/1965 | Young | 30/293 X |
| 3,418,713 | * | 12/1968 | Bauer | 30/277.4 |
| 3,653,124 | * | 4/1972 | Evans | 30/293 |
| 3,945,117 | * | 3/1976 | Beaver | 30/287 |
| 4,205,440 | * | 6/1980 | Morgan | 30/294 X |
| 4,215,475 | | 8/1980 | Morford . | |
| 4,395,825 | | 8/1983 | Lock . | |
| 4,543,720 | | 10/1985 | Grunikiewicz . | |
| 4,569,133 | * | 2/1986 | Schmidt | 30/293 X |
| 4,802,280 | * | 2/1989 | LaPiana | 30/293 |
| 4,852,261 | | 8/1989 | Wittek | 30/347 |
| 4,955,124 | * | 9/1990 | Asbery . | |
| 5,038,478 | | 8/1991 | Mezger | 30/272.1 |
| 5,421,230 | | 6/1995 | Flaherty | 83/13 |
| 5,480,507 | | 1/1996 | Arnold | 156/344 |
| 5,509,187 | * | 4/1996 | Gold . | |
| 5,784,788 | * | 7/1998 | Cothery . | |

FOREIGN PATENT DOCUMENTS

| | | |
|---|---|---|
| 0610655 | 5/1989 | (AU) . |
| 0045249 | 2/1982 | (EP) . |
| 0141035 | 2/1985 | (EP) . |
| 0532913 | 3/1993 | (EP) . |

OTHER PUBLICATIONS

Abstracts of DE 3304981 (Jun. 1984), DE 3210212 (May 1983), DE 3324676 (Oct. 1984), DE 4222250 (Jan. 1994), EP 433539 (Jun. 1991), EP 294617 (Dec. 1988), JP 06086816 (Mar. 1994), JP 08001598 (Jan. 1996).

* cited by examiner

*Primary Examiner*—Kenneth E. Peterson
(74) *Attorney, Agent, or Firm*—Roylance, Abrams, Berdo & Goodman, L.L.P.

(57) ABSTRACT

A device for severing a bonding strip located between and securing together two rigid panels, one of which may be of glass. The device has a flat elongated blade intended, in use, to be inserted between the panels to sever the bonding strip. The device is provided with a rest mechanism adapted to sit on one of the panels being separated to guide reciprocation of the elongated blade, whereby the blade reciprocates in a direction parallel to the panel being separated.

28 Claims, 3 Drawing Sheets

WINDSCREEN REMOVAL DEVICES

FIELD OF THE INVENTION

The present invention relates to improvements in apparatus for removing windscreens or other similar panels from vehicle bodies or the like. The apparatus is intended to separate a bonding layer between the panel to be removed and the supporting frame work surrounding same.

BACKGROUND OF THE INVENTION

U.S. Pat. No. 4,395,825 granted to Trevor S. Lock discloses apparatus of the aforementioned kind comprising a device for reciprocating a flat elongated flexible blade sharpened to one face along longitudinal edges and a curved end joining the longitudinal edges. The blade is reciprocated along the panel to be removed to separate the bonding layer. This type of apparatus has proved to be quite successful, particularly when used by skilled workmen, however, there are some problems when the apparatus is used by inexperienced workmen. These difficulties include, in some cases a difficulty in keeping the blade flat on the panel being removed and at the same time judging the depth of cut (reciprocation) required to separate the bonding layer without contacting and causing at least minor or superficial damage to the frame work surrounding the panel to be removed. Similarly, damage can occur to the panels themselves or coatings applied thereto. Further damage may occur to trim or other components on or surrounding the panel being removed. A still further problem is that if the blade is not held generally parallel to or flat on the panel, then a very poor or inefficient cutting operation results.

SUMMARY OF THE INVENTION

Objects of the present invention are therefore to provide improvements to apparatus of the type disclosed in the Lock Patent which will enable such apparatus to be used while at least minimising the aforementioned difficulties. It will of course be appreciated that the present invention is not limited to use with blades as defined in the Lock Patent but blades are clearly preferred. According to a first aspect, the present invention provides a device for severing a bonding strip interposed between and securing together overlapping portions of respective rigid elements, said device including a generally flat cutting blade portion shaped and arranged to, in use, engage the bonding strip between the overlapping portions in a cutting action to sever at least one of the overlapping portions from the bonding strip, and rest means adapted to engage the rigid element from which the bonding strip is being severed at a location spaced from the cutting blade portion to, in use, provide guidance for the movement of the cutting blade portion during said severing operation.

Conveniently, the cutting blade has a flat face on one side thereof defining a perimetal cutting edge and the opposite side is inclined upwardly from said cutting edge to provide support for the cutting edge.

In accordance with a second aspect, the present invention provides that, in use, the flat face is in contact with the rigid element from which the bonding strip is to be severed, and wherein the rest means is rigidably supported relative to the cutting blade to, in use, engage the rigid element from which the bonding strip is to be removed so that flat face of the cutting blade is in face to face contact with said rigid element.

In one preferred arrangement, the blade may be a generally flat elongated blade which is sharpened as disclosed in the Lock U.S. patent previously referred to. In another preferred arrangement, the blade may comprise any other form of blade known for this purpose including those which are oscillated during their cutting motion.

In one preferred arrangement, the panel removing blade may be a generally flat elongated blade which is sharpened as disclosed in Australian Patent No. 543405 and reciprocated in a cutting motion. In other preferred arrangements, the panel removing blade may comprise any other form of blade known for this purpose including those which are oscillated during their cutting motion.

In one preferred embodiment, the rest means may comprise a surface located in a plane generally parallel to a transverse dimension of the flat cutting blade portion. Alternatively, the rest means might be formed by two surfaces defining a plane generally parallel to a transverse dimension of the flat cutting blade portion. Conveniently, the plane of the or each said surface of the rest means is angled obliquely towards the flat cutting blade portion.

In a further preferred embodiment, the rest means may comprise an edge portion disposed generally parallel to a transverse dimension of the flat cutting blade portion. Alternatively, the rest means might be formed by at least two edge portions together defining a rest edge configuration disposed generally parallel to a transverse dimension of the flat cutting blade portion.

In a still further preferred embodiment, the rest means may comprise at least two point contacts defining a contact line extending therebetween disposed generally parallel to a transverse dimension of the flat cutting blade portion.

In a preferred arrangement, two said rest means are provided on diametrically opposed sides of the flat elongated panel removing blade.

The present invention also proposes providing, as a preferred feature, a stop element which is adapted, in use, to be located adjacent an end region of a flat elongated panel removing blade whereby the end region of the blade is positioned at a predetermined distance relative to the end zone of the stop element. Conveniently, the stop element is adjustable relative to the flat elongated panel removing blade to adjust the distance between the end of the blade and the end zone of the stop element. Preferably, the stop element is at least as transversely flexible as the blade. Normally, when a panel is being removed, the blade will extend beyond the end zone of the stop element but, for trimming purposes after a panel has been removed, the stop element may extend beyond the end zone of the blade.

BRIEF DESCRIPTION OF THE DRAWINGS

Several preferred embodiments of the present invention will hereinafter be described with reference to the accompanying drawings, in which.

DETAILED DESCRIPTION OF THE INVENTION

Figures 1, 2, 3:
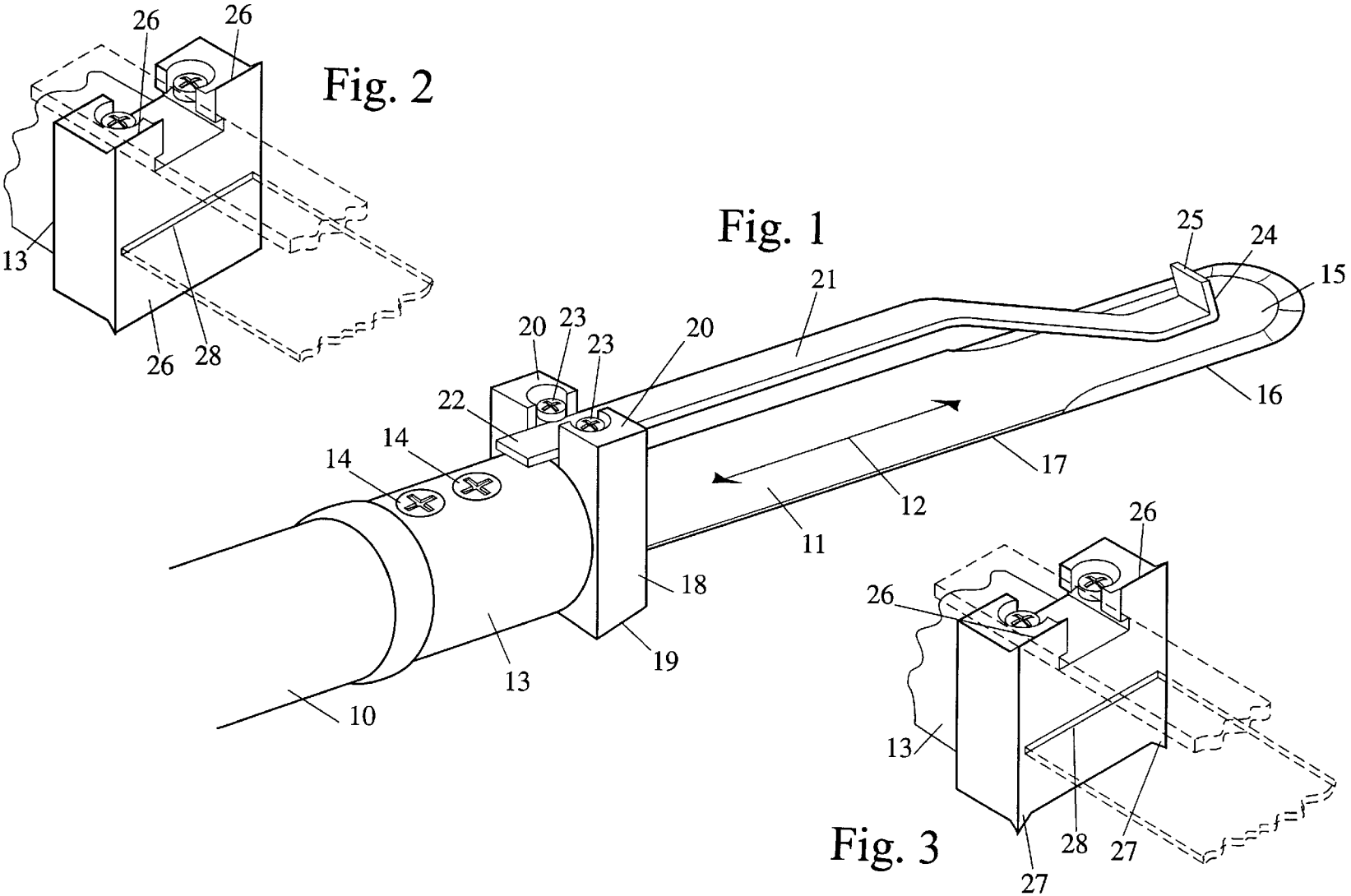
FIG. 1 is a perspective view of a first embodiment of the present invention.
FIG. 2 is a partial perspective view showing a second possible embodiment of the present invention.
FIG. 3 is a partial perspective view showing a third possible embodiment of the present invention.

FIG. 1 of the drawings shows an end of a tool 10 for reciprocating an elongated flat blade 11 in a direction indicated by arrow 12. The tool 10 is conveniently actuated pneumatically but any other means of reciprocation could also be utilised. It will of course also be appreciated that a tool for oscillating a cutting blade could also be used. One preferred form of guidance cap 13 is shown secured to the end of the tool 10 by set screws 14. In a possible alternative, the arrangement of the cap 13 may be integrally formed with the end of the tool 10. The blade 11 passes through an end opening 28 in the guidance cap 13 and is secured by fastening means to the operating mechanism of the tool 10. An access opening is provided through the cap 13 to permit access to the blade fastening means so that the blades can be replaced when desired. The blade 11 is conveniently sharpened at its end section 15 in a manner similar to that described in the Lock Patent such that there is a sharpened edge 16 located in a lower blade surface 17 of the blade. The guidance cap is conveniently formed with a block section 18 which includes at least one rest surface 19. As shown in the drawing, the rest surface 19 is obliquely disposed such that it is angled towards the blade 11. In this manner, in use, the rest surface 19 is placed in contact with the glass or other panel (such as a windscreen) and the blade 11 is thereby automatically located so that it will reciprocate in the plane of the panel being removed. Moreover, by angling the surface 19, the blade end region 15 is directed towards contact with the panel being removed. It will of course be appreciated that the surface 19 could be replaced by two or more surfaces, by an edge as shown in FIG. 2 formed by one or more edge lines 26, or by at least two point contacts 27 as shown in FIG. 3, each of which being arranged to maintain the blade 11 in contact with and parallel to the panel surface. It will further be appreciated that, if desired, the top surface 20 opposite to the surface 19 could also form a rest or guidance surface and in which case the blade 11 would be removed and inverted or turned over. This surface (or surfaces) 20 could also be obliquely formed similar to surface 19.

The guidance cap 13 also includes a stop element 21 in the form of an elongated bar or strip having a first end 22 releasably held in the cap 13 by screw elements 23. The stop element 21 is conveniently flexible longitudinally such that this element can flex as the blade 11 flexes. The opposed end 24 of the stop element defines a limit of depth of cut of the end region 15 of the blade 11. The end 24 may be formed with a bent section 25 as illustrated but other arrangements could be utilised depending on the task required to be performed. To adjust the depth of cut, the screw elements 23 are loosened and the stop element 21 repositioned to define the desired distance between the element end 24 and the end 15 of the blade 11. Thereafter, the screw elements 23 are re-tightened to fix the stop element 21 in position.

Figure 4:
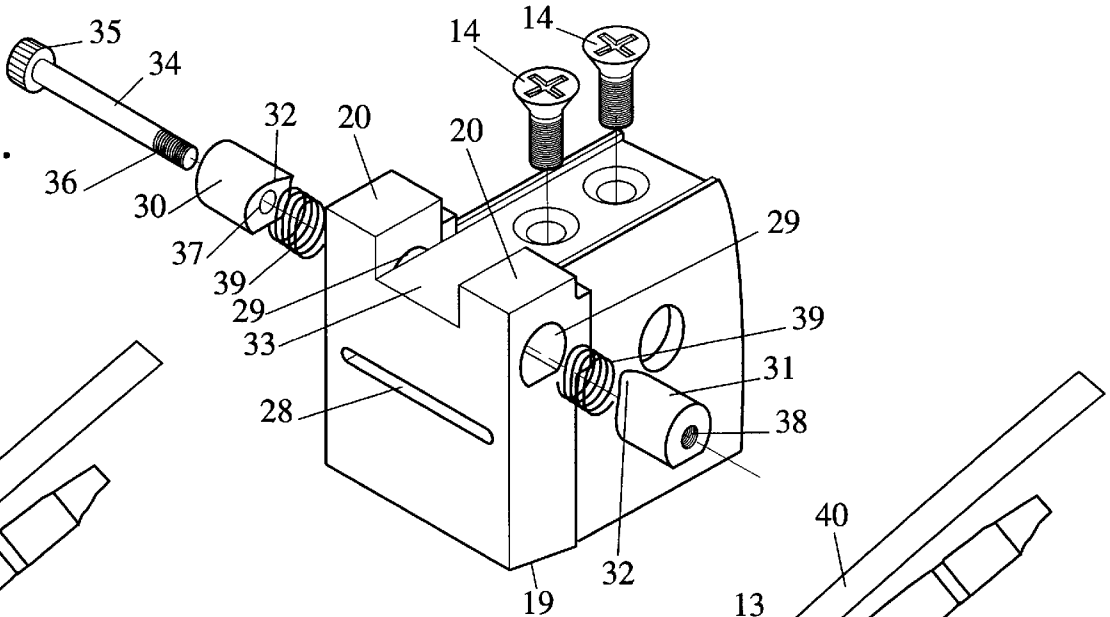
FIG. 4 is an exploded view of an alternative preferred guidance device adapted for connection to a panel removal tool.

FIG. 4 illustrates an alternative preferred form of guidance cap 13 where like features have been given the same reference numbers as in FIG. 1. In this embodiment, the stop elements are retained by a novel mechanism which allows quick and easy adjustment of the stop element 21 relative to the blade 11. The cap 13 includes aligned cross bores 29 adapted to receive plug elements 30, 31. Each of the plug elements 30, 31 has a non-circular cross-section thereby preventing rotation of same within the cross bores 29 so that the plug elements can move axially but not rotationally. Further, each plug element has a projecting ledge portion 32 adapted to project into the section 33 adapted to receive the stop element 21 such that the projecting ledge portions 32 will engage and hold the stop element 21. In addition the section 33 is extended along the top of the guidance cap 13 to provide further rigidity of holding of the stop element 21. Finally, a fastener bolt 34 is provided with a head 35 and a screw threaded section 36 opposite to the head. The bolt 34 passes freely through the internal bore 37 of the plug element 30 to be threadingly engaged with a threaded internal bore 38 of the second plug element 31. Rotation of the bolt 34 in one direction will tend to move the plug elements 30, 31 apart to loosen their grip on the stop element 21 and rotation in an opposite direction will draw the plug elements 30, 31 together tightening their grip on the stop element 21. Spring elements 39 are provided to maintain tension on the assembly preventing unwinding of the bolt 34 unintentionally during use of the device. As with the embodiment of FIG. 1, the guidance cap 13 also includes guidance rest surfaces 19, 20.

Figure 6:
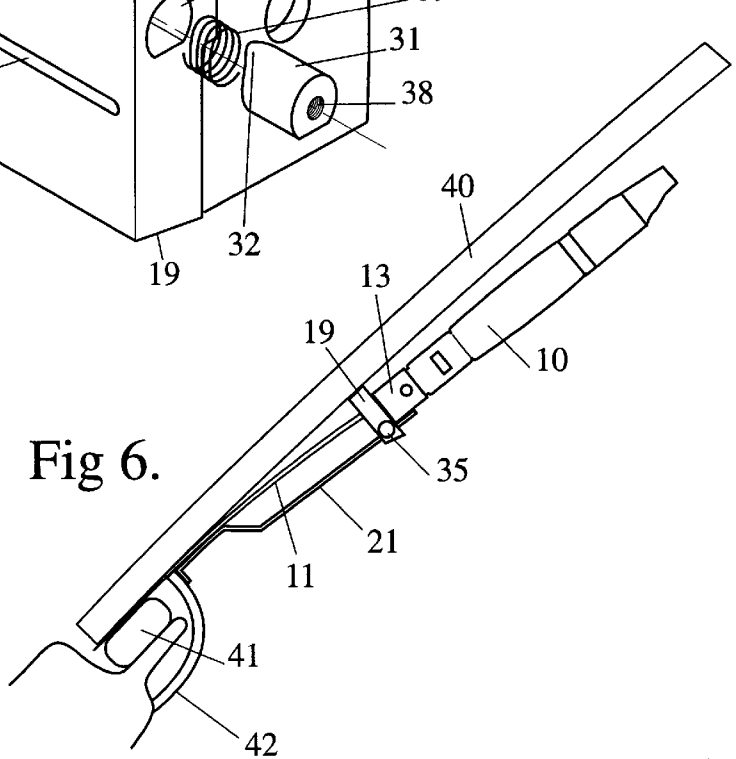
FIGS. 5, 6, 7 and 8 are side elevation views of preferred forms of panel removal tool according to the present invention shown in differing configurations of use.
Figure 5:
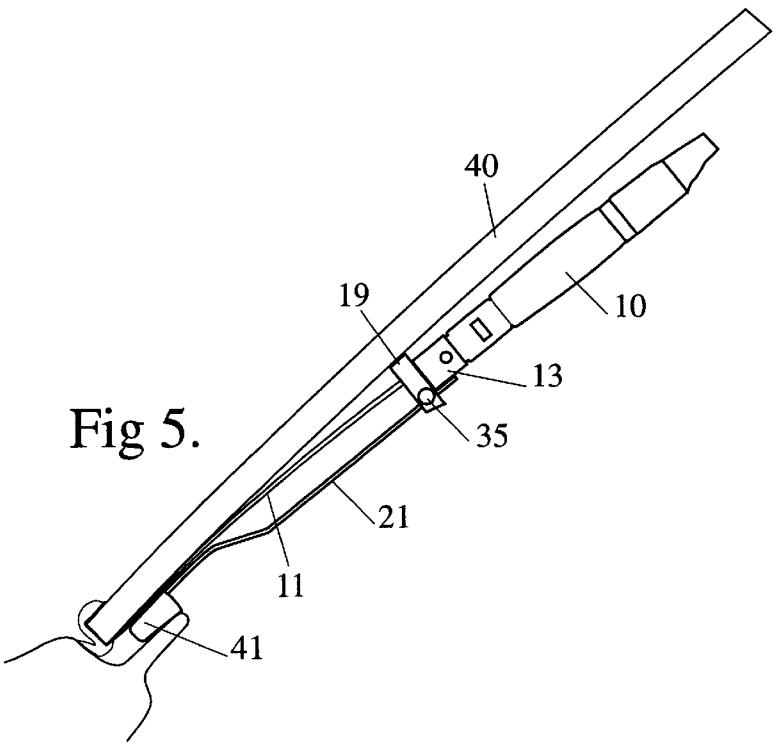
Figure 7:
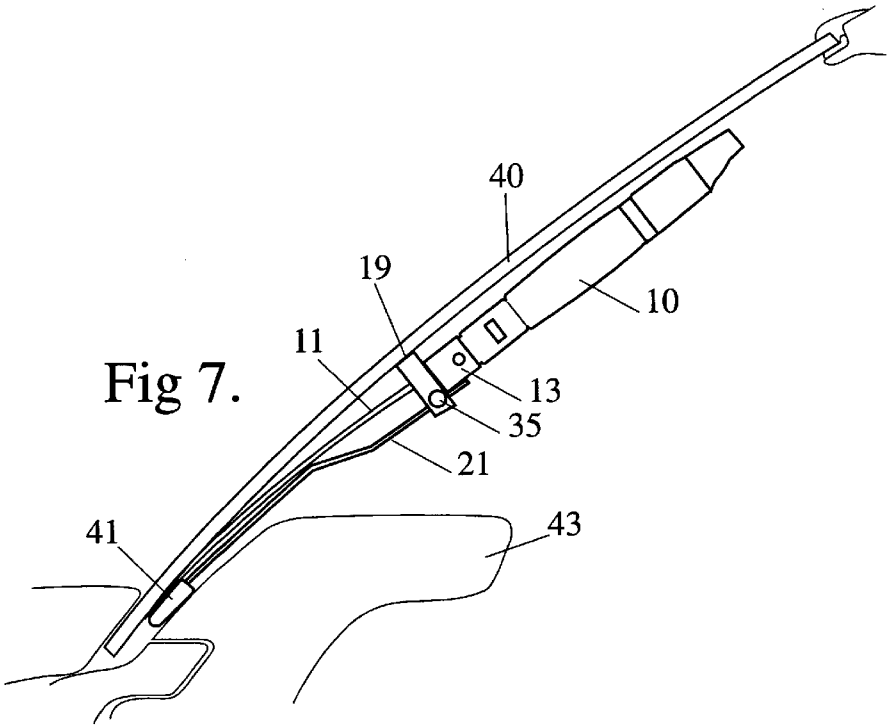
Figure 8:
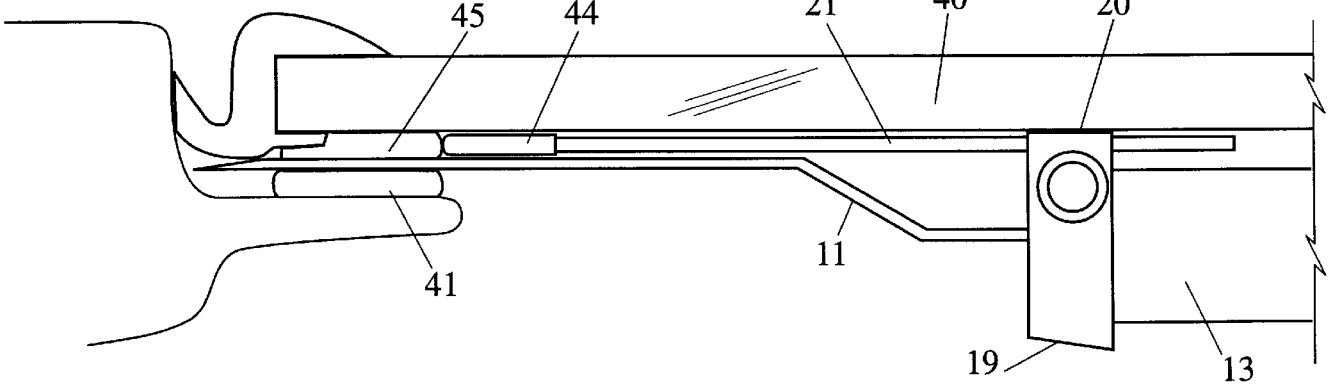

Referring now to FIG. 5, a panel removal tool 10 is shown with a guidance cap 13 positioned with its guidance rest surface 19 against the windscreen panel 40 being removed. The stop element 21 has a free end zone that engages against the urethane seal 41 that is being cut by the blade 11 reciprocated along the surface of the panel 40. It is apparent that this arrangement prevents the blade contacting and damaging structural parts of the vehicle frame around the panel 40. FIG. 6 illustrates an arrangement similar to FIG. 5 except that in this case, a cowling 42 generally covers the urethane seal 41 being cut. In this case, a different form of stop element (similar to FIG. 1) is used where the end section 25 engages the cowling 42. FIG. 7 is also an arrangement similar to FIG. 1 where the blade 11 and stop element 21 may reach a long way beyond a vehicle dashboard structure 43 or the like. FIG. 8 illustrates a still further arrangement where the stop element 21 engages the panel 40 being removed and the blade reciprocates along an end piece 44 on the stop element 21. In this case the guidance surfaces 20 are maintained in contact with panel 40 being removed. Further, a portion of the urethane seal 45 may be left to be trimmed off later.

By the arrangements described, it is possible in a simple and convenient manner to maintain the blade 11 always parallel to the surface of the panel being removed and moreover to restrict the blade depth of cut to only that which is required to allow removal of the panel.

The claims defining the invention are as follows:

1. A device for severing a bonding strip interposed between and securing together overlapping portions of two rigid elements, comprising:

a generally flexible flat cutting blade having a cutting edge at a first end thereof and a tool attachment at a second end thereof, opposite said first end thereof, said cutting blade portion having a first flat side and a second flat side;

rest means, coupled to said flexible flat cutting blade, for engaging one of the rigid elements at a location spaced from said cutting edge when said cutting edge engages the bonding strip to guide reciprocal movement of said flexible flat cutting blade during a severing operation; and a stop element coupled at a first longitudinal end thereof to said rest means and having a free distal longitudinal end spaced longitudinally between said first and second ends of said flat cutting blade, said stop element being flexible and extending only on said first flat side of said cutting blade portion such that said second flat side of said cutting blade portion can be positioned in contact with one of the rigid elements and said distal end of said stop element can abut said bonding strip or other structure coupled to the rigid elements to sever said bonding strip from said one of said rigid elements while preventing excessive penetration of the blade.

2. A device according to claim 1 wherein said free distal longitudinal end is located adjacent to said flat flexible cutting blade.

3. A device according to claim 1 wherein the free distal longitudinal end is selectably adjustable to different positions relative to the first end of said flat flexible cutting blade.

4. A combination of a guidance cap, rest means and apparatus with the guidance cap secured to an end portion of the apparatus used for severing a bonding strip interposed between and securing together overlapping portions of two rigid elements with a generally flat flexible cutting blade extending forwardly from the end portion of the apparatus, said cutting blade portion having a first flat side, a second flat side, a cutting edge at a first end thereof, attachment means at a second end thereof, opposite to said first end, and drive means connectable to the attachment means to, in use, drive said cutting blade in a reciprocal manner, said guidance cap comprising: a stop element and a body portion secured to the end portion of the apparatus by first connection means and having a guidance aperture through which the flat flexible cutting blade is adapted to project when said body portion is secured to the apparatus, said body portion being coupled to the rest means with the rest means having a first engagement structure defining a first contact line positionable on one of said two rigid elements at a location spaced from the cutting edge of the flexible flat cutting blade when the cutting edge engages the bonding strip upon reciprocal movement of the flat cutting blade during a severing operation, said first contact line of said first engagement structure being configured relative to said first connection means of said body portion such that said first contact line is maintained in use substantially parallel to the plane of the flat flexible cutting blade, said stop element being coupled at one longitudinal end of said stop element to said rest means and having a free distal longitudinal end spaced longitudinally between said first and second ends of said flat flexible cutting blade, said stop element being flexible and extending only on said first flat side of said cutting blade portion such that said second flat side of said blade can be positioned in contact with one of the rigid elements and said distal end of said stop element can abut said bonding strip or other structure coupled to the rigid elements to sever said bonding strip from said one of said rigid elements while preventing excessive penetration of the blade.

5. A combination according to claim 4 wherein said first contact line is spaced laterally from the flexible cutting blade whereby at least a longitudinally extending portion of the flexible cutting blade flexes and the cutting edge is maintained parallel to the one rigid element when said first contact line is positioned thereon.

6. A combination according to claim 5 wherein said rest means includes a second engagement structure defining a second contact line spaced from said first contact line on an opposite side of said flat flexible cutting blade relative to said first contact line, said second contact line of the second engagement structure also being parallel to the plane of said flat flexible cutting blade.

7. A combination according to claim 4 wherein the free distal longitudinal end of said stop element includes an end piece engageable by a flat face of said flat flexible cutting blade, said end piece being positioned in engagement with at least one of said two rigid elements during a severing operation.

8. A combination according to claim 4 wherein said first and second sides are parallel and surfaces connected by opposite parallel edges, said parallel surfaces being substantially wider than said parallel edges;

said first contact lines is adjacent said first parallel surface.

9. A device for severing a bonding strip interposed between and securing together overlapping portions of two rigid elements, comprising:

a generally flat flexible cutting blade having a longitudinally extending cutting blade portion with a cutting edge at a first end thereof and having attachment means at a second end thereof, opposite said first end, said cutting blade portion having a first flat side and a second flat side;

drive means connectable to said attachment means to, in use, drive said cutting blade in a reciprocal manner;

rest means having a first engagement structure defining a first contact line positionable on one of said two rigid elements at a location spaced from said cutting edge when said cutting edge engages the bonding strip upon reciprocal movement of the flat flexible cutting blade during a severing operation, said first contact line of the first engagement structure being parallel to the plane of said flat flexible cutting blade; and a stop element coupled at one longitudinal end of said stop element to said rest means and having an opposite free distal end spaced longitudinally between said first and second ends of said flat flexible cutting blade, said stop element being flexible and extending only on said first flat side of said cutting blade portion such that said second flat side of said cutting blade portion can be positioned in contact with one of the rigid elements and said distal end of said stop element can abut said bonding strip or other structure coupled to the rigid elements to sever said bonding strip from said one of said rigid elements while preventing excessive penetration of the blade.

10. A device according to claim 9 wherein the free distal longitudinal end of said stop element includes an end piece engageable by a flat face of said flat flexible cutting blade, said end piece being positioned in engagement with at least one of said two rigid elements during a severing operation.

11. A device according to claim 9 wherein said first and second sides are parallel and surfaces connected by opposite parallel edges, said parallel surfaces being substantially wider than said parallel edges;

said first contact line is adjacent said first parallel surface.

12. A device according to claim 1 wherein the first planar contact surface is angled obliquely towards the flat flexible cutting blade.

13. A device according to the claim 9 wherein said first contact line is spaced laterally from said flexible cutting blade whereby at least said cutting blade portion of said flexible cutting blade flexes and said cutting edge is maintained parallel to said one rigid element when said first contact line is positioned thereon.

14. A device according to claim 13 wherein said rest means includes a second engagement structure defining a second contact line spaced from said first contact line on an opposite side of said cutting blade portion relative to said first contact line, said second contact line of the second engagement structure also being parallel to the plane of said flat flexible cutting blade.

15. A device according to claim 14 wherein the second contact line is defined by a straight line joining free ends of two spaced point contact members.

16. A device according to claim 14 wherein said first contact line is spaced laterally from said flexible cutting blade whereby at least said cutting blade portion of said flexible cutting blade flexes and said cutting edge is maintained parallel to said one rigid element when said first contact line is positioned thereon.

17. A device according to claim 14 wherein said second contact line is spaced laterally from said flexible cutting blade whereby at least said cutting blade portion of said flexible cutting blade flexes and said cutting edge is maintained parallel to said one rigid element when said second contact line is positioned thereon.

18. A device according to claim 14 wherein the first contact line is defined by a straight line joining free ends of two spaced point contact members.

19. A device according to claim 14 wherein the first contact line is defined by an edge.

20. A device according to claim 14 wherein the second contact line is defined by an edge.

21. A device according to claim 14 wherein the second engagement structure is defined by a second planar contact surface.

22. A device according to claim 14 wherein the first engagement structure is defined by a first planar contact surface.

23. A device according to claim 9 wherein the first contact line is defined by an edge.

24. A device according to claim 9 wherein the first contact line is defined by a straight line joining free ends of two spaced point contact members.

25. A device according to claim 9 wherein the first engagement structure is defined by a first planar contact surface.

26. A device according to claim 9 wherein said stop element comprises a longitudinally flexible elongated strip extending between said ends of said stop element;

whereby said flat flexible cutting blade and stop element can flex together.

27. A device according to claim 9 wherein said stop element comprises an end piece at said opposite distal end thereof, said end piece having first surface to engage one of said two rigid elements and a second surface engaging and guiding reciprocation of said flat flexible cutting edge.

28. A device according to claim 9 wherein said rest means defines a first contact plane including said first contact line and extending at an acute angle relative to said flat flexible cutting blade when said flat flexible cutting blade is unflexed.

* * * * *